United States Patent [19]

Nonaka

[11] Patent Number: 5,044,188

[45] Date of Patent: Sep. 3, 1991

[54] BENDING DEVICE FOR SMALL-DIAMETER PIPES

[75] Inventor: Satoru Nonaka, Shizuoka, Japan

[73] Assignee: Usui Kokusai Sangyo Kaisha Ltd., Japan

[21] Appl. No.: 512,664

[22] Filed: Apr. 20, 1990

[30] Foreign Application Priority Data

Apr. 25, 1989 [JP] Japan ..... 1-105085

[51] Int. Cl.[5] ..... B21D 7/024

[52] U.S. Cl. ..... 72/217; 72/219; 72/387

[58] Field of Search ..... 72/215, 217, 218, 219, 72/369, 387, 388

[56] References Cited

U.S. PATENT DOCUMENTS

| | | | |
|---|---|---|---|
| 533,965 | 2/1895 | Richard | 72/224 |
| 567,811 | 9/1896 | Lefevre | 72/215 |
| 2,266,912 | 12/1941 | Shaw, Jr. | 72/481 |
| 2,557,579 | 6/1951 | Stringfield | 72/215 |
| 4,052,875 | 10/1977 | Sakamoto | 72/217 |

*Primary Examiner*—Lowell A. Larson
*Assistant Examiner*—Thomas C. Schoeffler
*Attorney, Agent, or Firm*—Anthony J. Casella; Gerald E. Hespos

[57] ABSTRACT

The present invention relates to a bending device for small-diameter pipes of various shapes usable as an oil, air or fuel supply path to be employed in automobiles and other various kinds of machines and equipment.

The bending device of the present invention includes a frame, a rotary actuator having a rotary arm, a pressure roll supported by a support erected on the rotary arm and passing through the frame and a plate-like jig fixed to the upper surface of the frame and provided with a shaping roll opposing the pressure roll. The plate-like jig is light in weight and replaceable with another jig so as to meet various pipe bending shapes so that the time and labor required for bending the pipe to different shapes are sharply saved thereby improving productivity.

6 Claims, 3 Drawing Sheets

PRIOR ART

BENDING DEVICE FOR SMALL-DIAMETER PIPES

BACKGROUND OF THE INVENTION

1. Field of the Invention

The present invention relates to a bending device for various kinds of pipes of different shapes each having a comparatively small diameter in the order of not more than about 20 m/m and a large thickness and which forms an oil, air or fuel supply path generally employed by an automobile or various kinds of machines and equipment.

2. Description of the Prior Art

Conventionally, it has been usual that a thick steel pipe is used as a fuel injection pipe of a diesel engine so as to withstand a high pressure. This pipe is provided with a connecting head for establishing its connection to the mating member and a clamping nut is fitted on the connecting head. Further, it is installed in a comparatively narrow space within the engine room as it is bent in a three-dimensional complicated form with respect to the fuel injection device. However, this type of pipe has a bent portion at a short distance from each end thereof and a nut is loosely fitted thereon so that a problem arises that it cannot be smoothly bent by a general automatic pipe bender which bends a tube at a plurality of portions in sequence in such a manner that a part of the pipe is fed between a stationary bending die and a rotary die while one end of the pipe is held clamped and the rotary die is rotated in a predetermined angle range in response to the movement of the pipe.

To meet the above difficulty, there has been provided, as a bending device, a unit bending jig 20 as shown in FIG. 5 which comprises a base 21 fixed with a bending die 22 of a shape corresponding to the desired bending shape and a stop wall 23 and a lever 25 attached with a die 24 and rotatable about the axis of the bending die 22. Where necessary, a plurality of such units may be prepared according to the number of bending steps so that the material pipe set on the base for each step of bending is bent at a plurality of portions in sequence by manually rotating the handle of the unit.

However, in the case of such a prior art device, the unit bending jig has generally been large-sized and of a heavy weight so that when the pipe is bent at each bending step or a tube having a different shape is bent, the bending unit must be replaced with another unit resulting in requiring much time and moreover, much labor is required for manual bending of the pipe resulting in lowering the productivity.

SUMMARY OF THE INVENTION

The present invention has been made in view of the above-described problem and an object of the present invention is to provide a small-diameter tube bending device which can be easily and quickly replaced at each bending step or every time when the pipe required to be bent to a different shape is processed and which can promote the productivity without any troublesome operation.

In order to achieve the above object, the gist of the bending device according to the present invention resides in the following structure. That is, the device comprises a rotary actuator which is provided with a horizontal rotary arm projecting from the rotary shaft thereof and arranged below a support plate attached to the lower part of a frame, a support member erected upright on one end of the rotary arm so as to move horizontally and passing through a semicircular slot formed in the frame, a pressure roll provided on top of the support member, a plate-like jig fixed to the upper surface of the frame and a shaping roll bolted to the upper surface of the plate-like jig through a central hole coaxially drilled in the jig with respect to the axis of the actuator. The plate-like jig comprises a positioning wall for positioning the material pipe at the time of bending the pipe and a stopper wall for setting the pipe bending angle and removably fixed to the frame through a positioning hole for receiving a positioning pin on the frame and a bolt screwed into the above-mentioned central hole of the jig.

With the above structure, the material pipe is bent by the rotation of the pressure roll around the shaping roll resulting from the rotation of the rotary actuator and in this case, as the horizontal position of the pressure roll with respect to the shaping roll can be preadjusted, the pressure roll is rotated with a desired radius of rotation. Further, as the jig provided with the positioning wall for setting the position of the material pipe corresponding to the bending shape of the pipe at each step of bending and the stopper wall can be mounted on, and dismounted from, the frame for replacement through mere used of the pin and bolt, the replacement of the jig can be performed easily and quickly without any troublesome operation thereby improving the productivity.

DETAILED DESCRIPTION OF PREFERRED EMBODIMENTS

Figure 1:
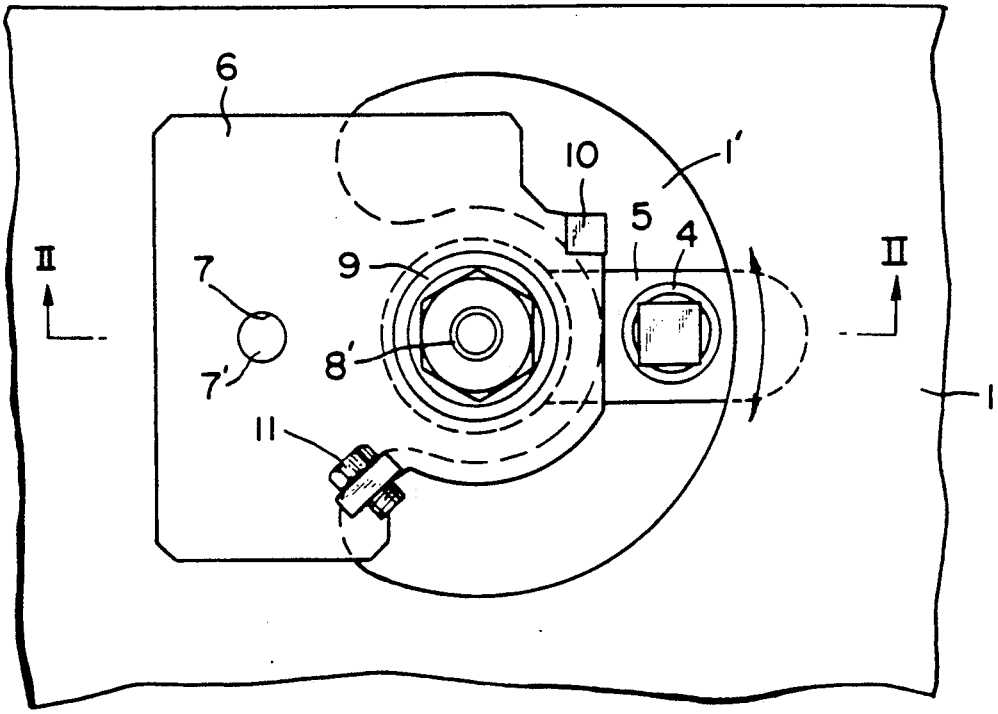
FIG. 1 is a plan view (partly cut away) of a small-diameter pipe bending device.
Figure 2:
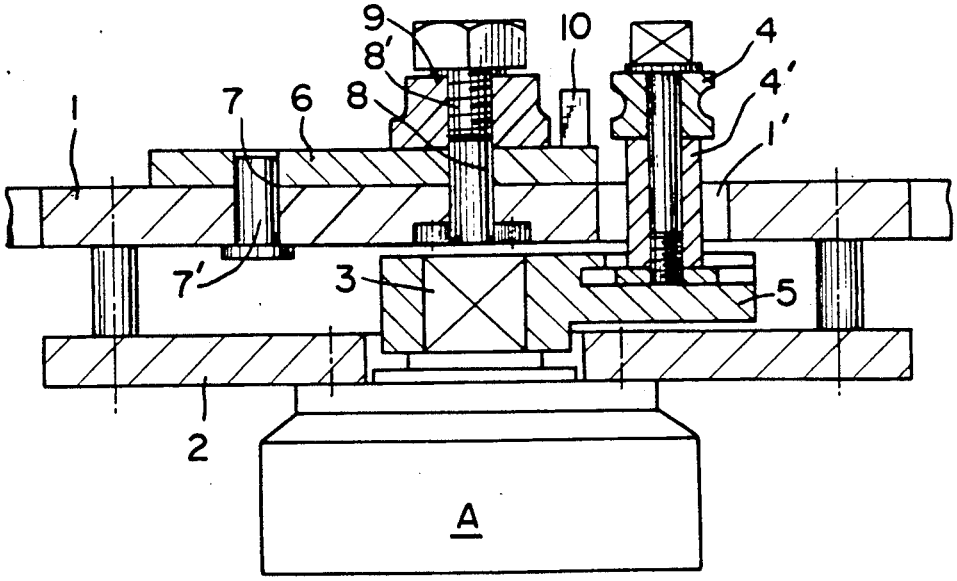
FIG. 2 is a vertical sectional view taken along the II—II line of FIG. 1.

In FIGS. 1 through 4, reference numeral 1 designates a frame which is held stationary by support legs (not shown) at the corner thereof and attached with a support plate 2 therebelow leaving a predetermined space from the latter. Under the support plate 2 there is arranged a rotary actuator A having a rotary shaft 3 provided with a rotary arm 5 extending horizontally through the above-mentioned space between the frame 1 and the support plate 2. Further, on the top end portion of the rotary arm 5 there is erected upright a support member 4' having a pressure roll 4 attached to the top end thereof with a bolt or the like. The pressure roll 4 is preferably rotatable with respect to the support member 4'. The support member 4' is movable horizontally and passes through a semicircular slot formed in the frame 1 and centering around the axis of the rotary shaft 3. Reference numeral 6 designates a plate-like jig which is provided with a positioning hole 7 at one end thereof so as to receive a positioning pin 7' formed on the upper surface of the frame 1, and a central hole 8 coaxial with the rotary shaft 3, at the other end thereof. Further, on the upper surface of the jig 6 and coaxially with the center hole 8, there is provided a shaping roll 9 which is fixed to the jig 6 with a bolt 8' screwed into the central hole 8. If desired, the central hole 8 may be deviated from the axis of the rotary shaft 3. The jig 6 with the inclusion of the shaping roll 9 is made detachable so that when the pipe material is required to be bent to a different shape, the jig 6 can be replaced with another jig suitable for bending the pipe to that shape with the pressure roll 4 thereof rotating around the above-mentioned shaping roll. Further, it will be understood that it is preferable to prepare a plurality of jigs of the above type in advance in correspondence to the number of bending steps and in that case, when they are used on the same frame, the distance between the positioning hole 7 and the central hole 8 drilled in each of them must be constant. Designated by reference numerals 10 and 11 are a positioning wall and a stopper wall, respectively, provided on the upper surface of the jig 6 of which the former is adapted to position the pipe P and the latter is adapted to set the bending angle of the pipe.

Figure 3:
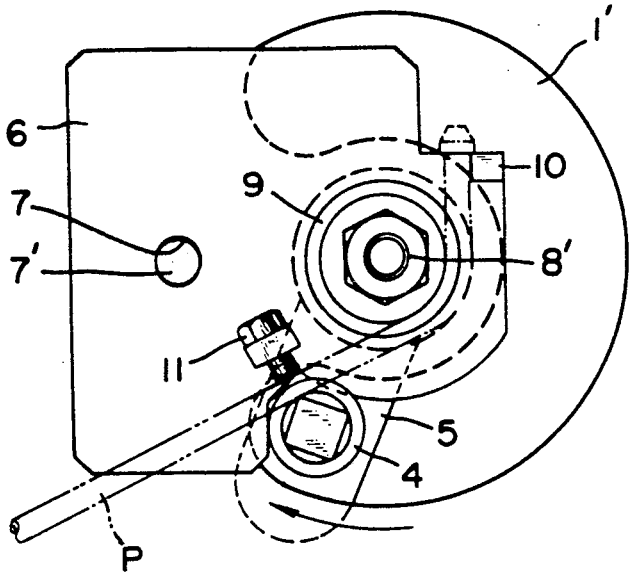
FIG. 3 is a view illustrating how a material pipe is bent by the bending device of the present invention.

In FIG. 3 which illustrates how the pipe is bent by a first bending step, the positioning wall 10 is so provided that it not only positions the connecting end of the pipe P to a point near the shaping roll 9 and behind the bending portion of the pipe, but also is subjected to a reaction force resulting from bending.

Figure 4:
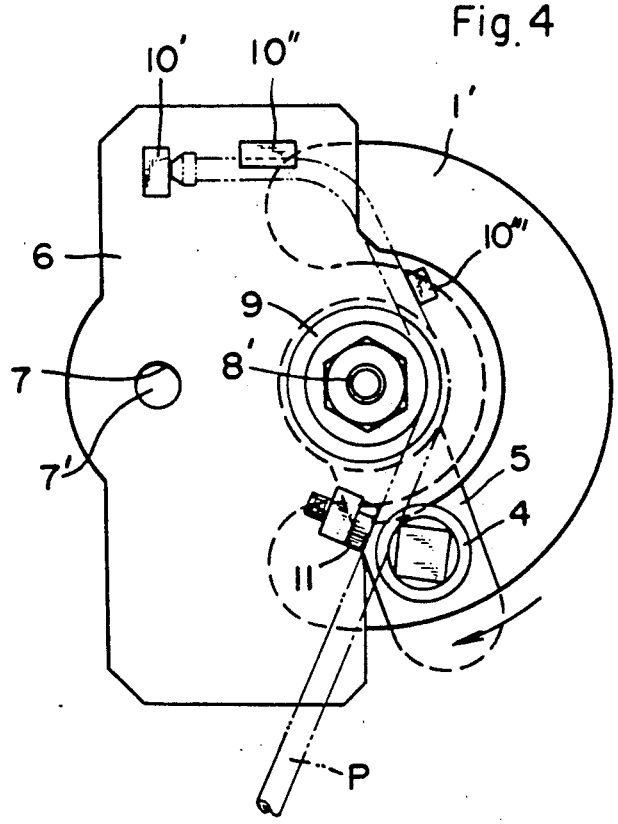
FIG. 4 is a view illustrating how the material pipe of FIG. 3 is further bent by a second bending step and FIG. 5 is a vertical sectional view of a conventional tube bending device.
Figure 5:
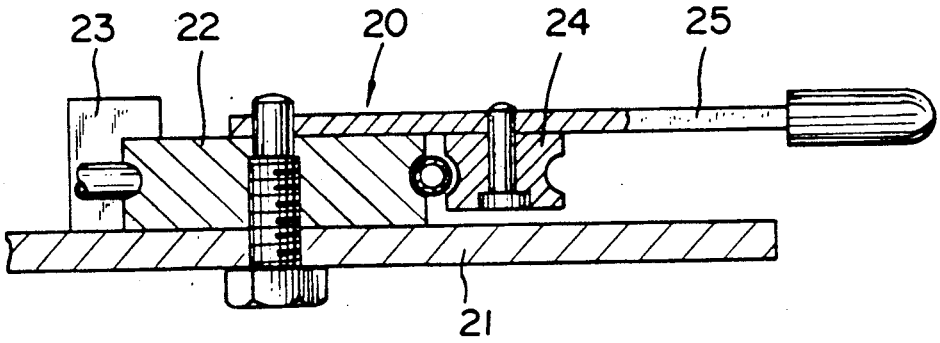

In FIG. 4 which illustrates how the material pipe is bent by a second bending step by use of a different jig, the jig 6 is provided with a plurality of wall sections including a positioning section 10' for positioning the top end of the pipe, an intermediate section 10'' to come into contact with the tube at the intermediate portion of the jig and a reaction force receiving section 10''' just before the bending portion of the pipe. Thus, by using such a jig, it is possible to make sure whether or not the shape of the pipe bent by the previous step is favorable thereby preventing errorneous bending of the pipe and the entry of a foreign matter. By the way, the solid-line arrow designates the direction of rotation of the pressure roll 4 around the shaping roll 9.

In operation, a plurality of the above bending devices are arranged according to the number of bending steps and the pipe blank is bent at desired portions in sequence. Where the pipe blank is required to be bent to a different shape, the bending jig on the frame of each device may be replaced with another unit jig suitable for the bending. Each unit jig used in the present invention is small-sized and light in weight so that the replacement thereof can be easily and quickly performed.

As described above, according to the small-diameter tube bending device of the present invention, the plate-like jig 6 provided on the upper surface thereof with the shaping roll 9 is removably fixed to the upper surface of the frame 1 by means of the bolt 8' with its positioning hole 7 receiving the pin 7' of the frame 1 and accordingly, if a plurality of such light-weight jigs whose positioning holes and central holes are formed at the same positions and having positioning walls 10 and stopper walls 11 at different positions, respectively, are prepared in advance, the pipe blank may be bent to the desired various shapes quickly and in a simple manner by merely replacing the jigs with one another. Further, since the position of the pressure roll 4 which rotates around the shaping roll 9 by the rotation of the rotary actuator A is adjustable horizontally with respect to the shaping roll, the applicable range of the device for pipes of different diameters is extended and at the same time, each pipe can be bent at a portion spaced a short distance from its end by rotating the pressure roll 4 with a desired radius of rotation. In addition, since the shape of the pipe blank bent by the previous step can be immediately ascertained by the positioning wall 10 of the jig at the next step and a plurality of bending devices of the present invention can be arranged according to necessity, each step of bending can be performed by a single operator thereby improving the productivity. Moreover, due to its simple structure, the bending device can be made small-sized and light in weight so that it may be handled more easily.

What is claimed is:

1. A bending device for small-diameter pipes, comprising: a frame having a semicircular slot; a rotary actuator arranged below the frame; the rotary actuator including a rotary shaft and a rotary arm projecting generally radially from the rotary shaft of the rotary actuator; a support member erected on a location on the rotary arm spaced from the rotary shaft and passing through the semicircular slot of the frame; a pressure roll attached to the top end of the support member; a bolt extending upward from the frame; a positioning pin extending upwardly from the frame at a location spaced from the bolt and the semicircular slot; at least one plate-like jig having a central hole and a positioning hole disposed relative to one another for receiving the bolt and the positioning pin extending upwardly from the frame, said jig further comprising a positioning wall and a stopper wall disposed to be in proximity to the semicircular slot when the jig is mounted to the bolt and positioning pin of the frame; and a shaping roll attachable to the upper portion of the bolt for retaining the plate-like jig to the frame, whereby the pipe is bent around the shaping roll by movement of the pressure roll by the rotary actuator, and whereby the positioning wall and the stopper wall define the limits of the bend.

2. A bending device according to claim 1, wherein said rotary actuator is mounted to a support plate fixed adjacent to the frame.

3. A bending device according to claim 1, wherein said shaping roll is fixed to the upper end of said bolt with a nut.

4. A bending device according to claim 1, wherein said plate-like jig is replaceable with another jig of the same structure except that the position of the positioning wall and that of the stopper wall thereof are differentiated from those of said first-mentioned jig.

5. A bending device according to claim 1, wherein said positioning wall of said plate-like jig is provided with a positioning section for positioning the top end of the pipe, an intermediate section for receiving the intermediate portion of the pipe and a stop section for receiving a reaction force generating when the pipe is bent.

6. A bending device according to claim 1 wherein said at least one plate-like jig comprises a plurality of jigs, the central hole and the positioning hole of each said jig being disposed to receive the bolt and the positioning pin extending from said frame, the relative position of at least one of said stopper wall and said positioning wall for each of said jigs being different than other ones of said jigs, whereby each said jig enables said bending device to complete a different bend in said pipes.

* * * * *